US006769572B1

(12) United States Patent
Cullotta

(10) Patent No.: US 6,769,572 B1
(45) Date of Patent: Aug. 3, 2004

(54) CUSTOM COLOR SPRAY PAINT CANS

(76) Inventor: Anthony Cullotta, 1108 Gulf Keys Rd., Elgin, IL (US) 60120

( * ) Notice: Subject to any disclaimer, the term of this patent is extended or adjusted under 35 U.S.C. 154(b) by 46 days.

(21) Appl. No.: 10/033,668

(22) Filed: Dec. 27, 2001

(51) Int. Cl.[7] ..... B67D 5/00

(52) U.S. Cl. ..... 222/5; 222/156; 222/399; 222/402.1

(58) Field of Search ..... 222/5, 83, 156, 222/158, 189.1, 386.5, 394, 399, 402.1

(56) References Cited

U.S. PATENT DOCUMENTS 1,935,973 A * 11/1933 Altmann ..... 141/19
3,865,158 A * 2/1975 Withrow ..... 141/19
4,310,108 A * 1/1982 Motoyama et al. ..... 222/396
4,702,396 A * 10/1987 Gwiazda ..... 222/152
5,022,565 A * 6/1991 Sturman et al. ..... 222/396
5,060,823 A * 10/1991 Perlman ..... 222/1
5,110,012 A * 5/1992 Scholle et al. ..... 222/83.5
5,236,262 A * 8/1993 Espey ..... 366/130
5,878,917 A * 3/1999 Reinhard et al. ..... 222/156
6,276,565 B1 * 8/2001 Parsons et al. ..... 222/52
6,394,319 B1 * 5/2002 Pucillo ..... 222/383.1

* cited by examiner

*Primary Examiner*—Joseph A. Kaufman
(74) *Attorney, Agent, or Firm*—Michael I Kroll

(57) ABSTRACT

A custom color spray paint can includes a removable and reattachlable lid that penetrates a replaceable gas cartridge as it is attached to a container holding the custom-mixed paint. The released gas pressurizes the container and forces paint through a nozzle when a release valve is opened.

27 Claims, 12 Drawing Sheets

CUSTOM COLOR SPRAY PAINT CANS

BACKGROUND OF THE INVENTION

1. Field of the Invention

The present invention relates generally to spray paint cans and, more specifically, to self-charging, manually loaded spray paint cans.

2. Description of the Prior Art

The present invention relates generally to spray paint cans and, more specifically, to self-charging, manually loaded spray paint cans. The pre-charged, standardized color spray paint cans available to the general populace via standard sales outlets do not offer the option to customize. Hence a need exists for a user-specified spray paint can system that is used, maintained, and operated with minimal effort.

The discharging of paint via compressed gas is particularly useful in instances where time is of the essence. Having a readily available system that can deploy various colors, types, and grades of paint for application is not only warranted, but also necessary in the modern world. Painting systems that offer the customization of paint often have costly apparatus, such as an air compressor, to deliver the user defined color. The present invention overcomes this bulky and costly machinery by minimizing the size of the system. Having a self-contained pressurization system allows the invention to be more portable, and also become more cost effective and more easily used by an individual.

The invention of a container containing a liquid that is to be evacuated by pressure is known throughout the art of the assigned class and subclasses. However, it is felt that a need exists for a container wherein a user designed custom color or alternate fluid may be deposited and subsequently discharged. This container should have a removable and reattachable lid that, upon attachment, will seal, puncture, and pressurize the contents of the container. Once pressurized, the custom color spray paint should allow the user to selectively release and direct the custom color paint.

While the prior art on the subject may be suitable for the purposes for which they were designed, they would not be as suitable for the purposes of the present invention.

SUMMARY OF THE PRESENT INVENTION

A primary object of the present invention is to provide a paint spray can that can be pressurized after a custom color has been added.

Another object of the present invention is to provide a container that is pressure resistant, having open and closed opposing ends. This pressure resistant container is threaded at the open end for the attachment of the cap structure.

Yet another object of the present invention is to provide a threaded cap structure that is pressure resistant and having a paint applicator for the release and direction of the paint. The cap structure will also have a puncturing pin extending downwardly so as to puncture the pressurized gas cartridge.

Another object of the present invention is to provide a pressure resistant seal between the container and cap structure.

Yet another object of the present invention is to provide an inner guide channel for the placement of the pressurizing gas cartridge. This channel is also utilized to guide the puncturing pin into position, ensuring the proper release of the pressurizing gas.

Still yet another object of the present invention is to provide a solid spherical object to ensure proper distribution of solid components suspended in solution prior to discharge.

Another object of the present invention is to provide a sight glass incorporated into the side of the pressure resistant container to view the proper level of paint or other fluid when filling the pressure resistant container.

Yet another object of the present invention is to provide a particle filter attached to the end of the spray nozzle feed tube to prevent large particulate matter from obstructing the spray nozzle or alternate egress port.

Still yet another object of the present invention is to provide a spray nozzle or other egress port for the immediate deployment of the added liquid.

Still yet another object of the present invention is to provide a puncturing pin to facilitate the release of gasses contained in the pressurization cartridge and thus the rapid pressurization of the container and its contents.

Still yet another object of the present invention is to provide a static or replaceable pressurizing device, most often embodied as a standard pressurized gas cartridge.

Still yet another object of the present invention is to provide a pressure resistant cap structure with an easily deformable center. This is to facilitate the puncturing of the pressurized gas cartridge by striking the cap structure and effectively puncturing the pressurized gas cartridge.

Still yet another object of the present invention is to provide an alternate embodiment having a pressurization port for the external pressurization of the pressure resistant container.

Additional objects of the present invention will appear as the description proceeds.

The present invention overcomes the shortcomings of the field by providing an easily reusable painting system wherein the contents of the pressure resistant container may be replaced or altered to suit the user's needs.

A paint dispenser is provided, comprising: a paint container for holding paint, the paint container having a removable and reattachable lid; a pressurized gas container having a puncturable discharge outlet, the gas container containing a pressurized gas, the gas container being positioned within the paint container; a puncturing member extending from the lid, the puncturing member being positioned with respect to the gas container discharge outlet such that attachment of the lid to the paint container causes the puncturing member to puncture the gas container discharge outlet, the punctured discharge outlet releasing the pressurized gas into the paint container, the released pressurized gas causing the paint container to become pressurized; and a paint application member having a release valve, the manipulation of the release valve allowing paint to be displaced from the paint container under pressure.

In another embodiment a hollow member is positioned within the paint container and about the gas container, forming an annulus between the hollow member and the gas container such that the paint in the paint container is segregable in the annulus, and further such that gas discharged from the gas container discharge outlet is routed by the hollow member to the annulus above the paint.

In another embodiment the dispenser further comprises an elongated transparent member, the paint container being adapted to position the transparent member on the paint container such that at least part of the interior of the paint container is visible from outside the paint container.

In another embodiment the dispenser further comprises a paint agitator member, the agitator member being unrestrained such that motion of the paint container causes the agitator member to move within the paint.

In another embodiment the paint application member is positioned on the paint container below the lid.

In another embodiment the paint application member is positioned on the lid, and further wherein the paint container has a bottom and the dispenser further comprises an elongated conduit having a first end in fluid communication with the paint application member and a second end positioned proximate the paint container bottom such that paint is drawn through the conduit from the bottom of the container.

In another embodiment the elongated conduit second end has a filter for filtering solid particles in the paint as the paint enters the elongated conduit.

In another embodiment the paint application member has a finger-operable nozzle, such that depression of the nozzle opens the release valve causing paint to be released for directed application through the nozzle.

In another embodiment the nozzle is adjustable for regulating the amount and pattern of paint discharge.

A paint dispenser is provided, comprising: a paint container for holding paint, the paint container having a removable and reattachable lid; a pressurized gas container having a puncturable discharge outlet, the gas container containing a pressurized gas, the gas container being positioned within the paint container; means for puncturing the discharge outlet, the punctured discharge outlet releasing the pressurized gas into the paint container, the released pressurized gas causing the paint container to become pressurized; and means for selectively releasing paint from the gas container under pressure and directing the released paint.

In another embodiment the dispenser further comprises means for segregating the paint from the gas container discharge outlet such that the released gas is released above the paint in the paint container.

In another embodiment the dispenser further comprises means for visually determining the level of paint in the gas container.

In another embodiment the dispenser further comprises means for agitating the paint in response to motion of the paint container.

In another embodiment the means for selectively releasing paint from the gas container is positioned on the lid, and further wherein the paint container has a bottom and the dispenser further comprises an elongated conduit having a first end in fluid communication with the means for selectively releasing paint from the gas container, and a second end positioned proximate the paint container bottom such that paint is drawn through the conduit from the bottom of the container.

In another embodiment the elongated conduit second end has means for filtering solid particles in the paint as the paint enters the elongated conduit.

A paint dispenser is provided, comprising: a paint container for holding paint, the paint container having a removable, reattachable, and deformable lid; a pressurized gas container having a puncturable discharge outlet, the gas container containing a pressurized gas, the gas container being positioned within the paint container; a puncturing member extending from the lid, the puncturing member being positioned with respect to the gas container discharge outlet such that deformation of the attached lid causes the puncturing member to puncture the gas container discharge outlet, the punctured discharge outlet releasing the pressurized gas into the paint container, the released pressurized gas causing the paint container to become pressurized; and a paint application member having a release valve, the manipulation of the release valve allowing paint to be displaced from the paint container under pressure.

In another embodiment a hollow member is positioned within the paint container and about the gas container, forming an annulus between the hollow member and the gas container such that the paint in the paint container is segregable in the annulus, and further such that gas discharged from the gas container discharge outlet is routed by the hollow member to the annulus above the paint.

In another embodiment the dispenser flirter comprises an elongated transparent member, the paint container being adapted to position the transparent member on the paint container such that at least part of the interior of the paint container is visible from outside the paint container.

In another embodiment the dispenser further comprises a paint agitator member, the agitator member being unrestrained such that motion of the paint container causes the agitator member to move within the paint.

In another embodiment the paint application member is positioned on the paint container below the lid.

In another embodiment the paint application member is positioned on the lid, and further wherein the paint container has a bottom and the dispenser further comprises an elongated conduit having a first end in fluid communication with the paint application member and a second end positioned proximate the paint container bottom such that paint is drawn through the conduit from the bottom of the container.

In another embodiment the elongated conduit second end has a filter for filtering solid particles in the paint as the paint enters the elongated conduit.

In another embodiment the paint application member has a finger-operable nozzle, such that depression of the nozzle opens the release valve causing paint to be released for directed application through the nozzle.

In another embodiment the nozzle is adjustable for regulating the amount and pattern of paint discharge.

In another embodiment, the lid deformation is elastic.

In another embodiment, the lid deformation is permanent.

A paint dispenser is provided, comprising: a paint container for holding paint, the paint container having a removable and reattachable lid; an inlet member adapted to interface with a pressurized gas container for introducing pressurized gas into the paint container, the introduced pressurized gas causing the paint container to become pressurized; and a paint application member having a release valve, the manipulation of the release valve allowing paint to be displaced from the paint container under pressure.

In another embodiment the dispenser further comprises an elongated transparent member, the paint container being adapted to position the transparent member on the paint container such that at least part of the interior of the paint container is visible from outside the paint container.

In another embodiment the dispenser further comprises a paint agitator member, the agitator member being unrestrained such that motion of the paint container causes the agitator member to move within the paint.

In another embodiment the paint application member is positioned on the paint container below the lid.

In another embodiment the paint application member is positioned on the lid, and further wherein the paint container has a bottom and the dispenser further comprises an elongated conduit having a first end in fluid communication with the paint application member and a second end positioned proximate the paint container bottom such that paint is drawn through the conduit from the bottom of the container.

In another embodiment the elongated conduit second end has a filter for filtering solid particles in the paint as the paint enters the elongated conduit.

In another embodiment the paint application member has a finger-operable nozzle, such that depression of the nozzle opens the release valve causing paint to be released for directed application through the nozzle.

In another embodiment the nozzle is adjustable for regulating the amount and pattern of paint discharge.

A paint dispenser is provided, comprising: a paint container for holding paint, the paint container having a removable and reattachable lid; means for interfacing with a pressurized gas container for introducing pressurized gas into the paint container, the introduced pressurized gas causing the paint container to become pressurized; and means for selectively releasing paint from the gas container under pressure and directing the released paint.

A paint dispenser is provided, comprising: a paint container for holding paint, the paint container having a bottom and a removable and reattachable lid; a pressurized gas container having a puncturable discharge outlet, the gas container containing a pressurized gas, the gas container being positioned within the paint container; a puncturing member extending from the lid, the puncturing member being positioned with respect to the gas container discharge outlet such that attachment of the lid to the paint container causes the puncturing member to puncture the gas container discharge outlet, the punctured discharge outlet releasing the pressurized gas into the paint container, the released pressurized gas causing the paint container to become pressurized; an elongated transparent member, the paint container being adapted to position the transparent member on the paint container such that at least part of the interior of the paint container is visible from outside the paint container; a hollow member positioned within the paint container and about the gas container, forming an annulus between the hollow member and the gas container such that the paint in the paint container is segregable in the annulus, and further such that gas discharged from the gas container discharge outlet is routed by the hollow member to the annulus above the paint; a paint agitator member, the agitator member being unrestrained such that motion of the paint container causes the agitator member to move within the paint; a paint application member having a release valve, the manipulation of the release valve allowing paint to be displaced from the paint container under pressure, the paint application member being positioned on the lid, the paint application member having a finger-operable nozzle, such that depression of the nozzle opens the release valve causing paint to be released through the nozzle, the nozzle being adjustable for regulating the amount and pattern of paint discharge; and an elongated conduit having a first end in fluid communication with the paint application member and a second end positioned proximate the paint container bottom such that paint is drawn through the conduit from the bottom of the container, the elongated conduit second end having a filter for filtering solid particles in the paint.

In another embodiment, the paint dispenser further comprises a seal member positioned between the dome cap and the container.

The foregoing and other objects and advantages will appear from the description to follow. In the description reference is made to the accompanying drawings, which form a part hereof, and in which is shown by way of illustrating specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which:

FIG. 1 is an illustration of the custom color spray paint can that can be seen in use. The containers may be filled with a variety of fluids to facilitate in the matching of specific colors. This convenience is particularly useful in repair work and the expedited application of paint.

FIG. 2 is a figure showing the primary embodiment of the present invention. The space between the guide tube and the outside container is filled with paint or other fluid and with the domed top attached, pressurization of the contents will occur. To prevent aeration of the fluid via the compressed gas, the guide tube extends above the surface level of the added fluid. A sight glass is incorporated into the wall of the outside container to facilitate proper fluid level while filling. Due to the variety of fluids or mixtures allowed in this invention, a particle filter is attached to the base of the spray nozzle feed tube to prevent nozzle clogging.

FIG. 3 is a view showing the level of paint or other fluid allowed with the primary embodiment. The guide tube may vary in height allowing more or less fluid in the cavity. For aeration of the contents, the guide tube is not necessary. The guide tube may also vary in diameter depending on the size of the pressurization cartridge.

FIG. 4 is a figure showing the system ready for pressurization. For pressurization to occur, the threaded cap is rotated on its threads to seat the puncturing pin firmly into the gas cartridge.

FIG. 5 is a view showing a screw-top type engagement system for pressurization of the container. With the domed cap in place and an unused gas cartridge in the guide tube, all that is required to pressurize the contents is the final quarter turn of the screw-type cap. The quarter turn is enough to bring the puncturing pin in contact with the gas cartridge. The cartridge is punctured and the contents are pressurized.

FIG. 6 is an embodiment where the container is pressurized by deforming the dome cap to push the puncturing pin into the gas cartridge to pressurize the container. The cap is made of tough flexible material that will not leak once pressurized, but with enough flex to allow the puncturing pin to strike the pressurized gas cartridge.

FIG. 7 is a sectional view of the primary embodiment showing all the major components of the device. Shown is the domed top and outside containing attached, but prior to pressurization. This sectional view encompasses both the primary puncture system and the alternate flexible top puncturing system. The offset nature of the spray nozzle feed tube is clearly depicted so as not to interfere with the pressurization components.

FIG. 8 is an alternate embodiment of the invention having the charging gas cartridge removed from the container. The paint or fluid is pressurized by mating the cartridge carrier with the inlet member, thus flowing the gas into the container. This embodiment allows for the maximum utilization of internal space and also has the capability to recharge the container without exposing the contents.

DESCRIPTION OF THE REFERENCED NUMERALS

Figure 1:
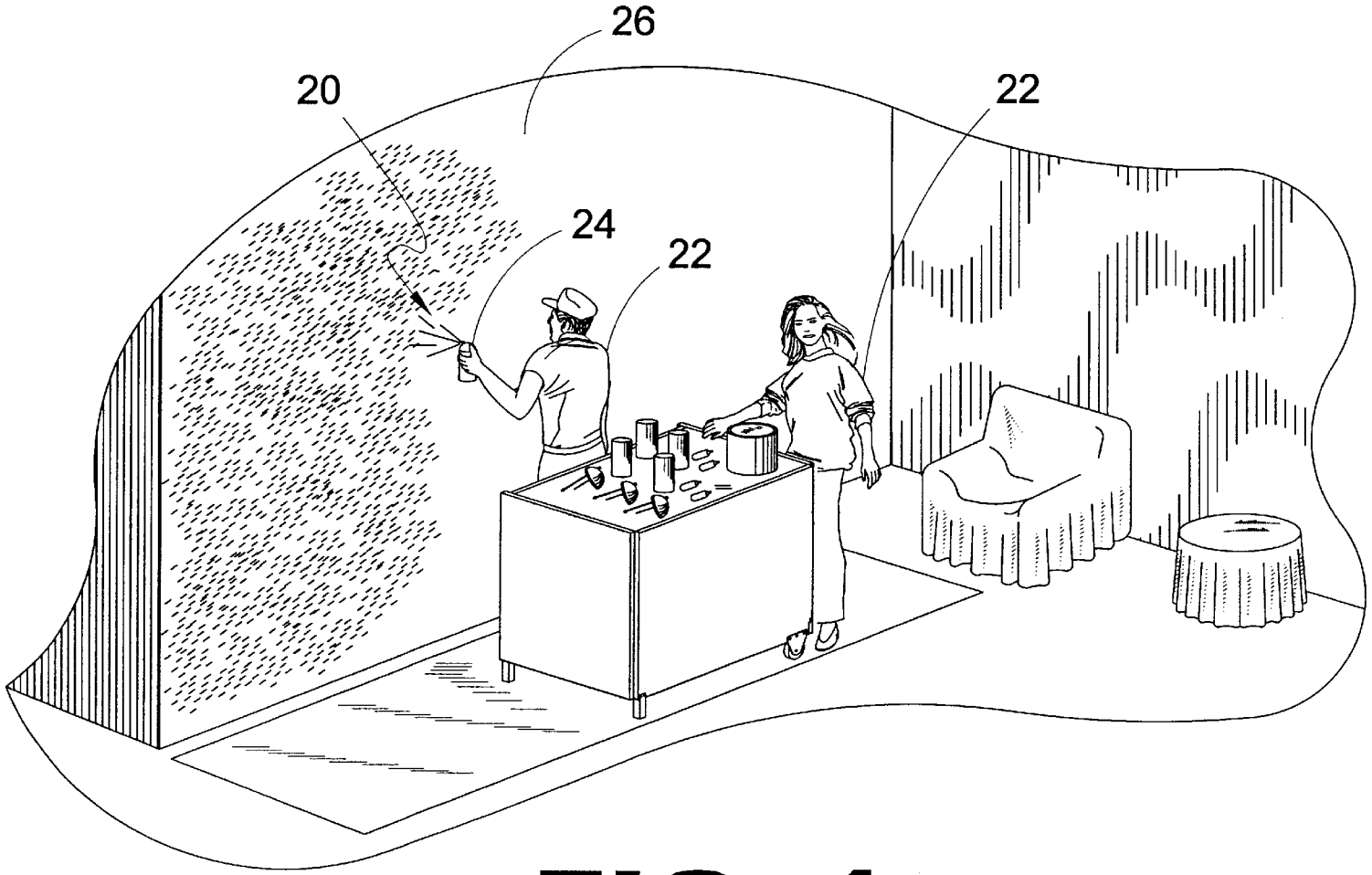

Turning now descriptively to the drawings, in which similar reference characters denote similar elements throughout the several views, the figures illustrate the custom color spray paint can of the present invention. With regard to the reference numerals used, the following numbering is used throughout the various drawing figures.

20 custom color spray paint can of the present invention
22 user
24 user's finger
26 wall surface
30 paint
32 paint container
34 paint container bottom
36 guide tube
38 guide tube opening
38 annulus
40 sight glass
42 threads
44 dome cap
46 puncturing pin
48 valve
50 nozzle
52 conduit
54 filter
56 ball
58 gas cartridge
60 gas cartridge pucturable discharge outlet
62 gas
100 alternate embodiment
102 dome cap
104 deformable dome cap apex
106 puncturing pin
200 alternate embodiment
202 inlet member
204 gas cartridge carrier
206 gas cartridge
208 gas
210 domed cap
212 nozzle
214 valve
216 conduit
218 filter

DETAILED DESCRIPTION OF THE INVENTION

The following discussion describes in detail various embodiments of the invention. This discussion should not be construed, however, as limiting the invention to those particular embodiments. Practitioners skilled in the art will recognize numerous other embodiments as well. For a definition of the complete scope of the invention, the reader is directed to the appended claims.

FIGS. 1–12 depict various embodiments of the custom color spray paint can 20 of the present invention. FIG. 1 illustrates the custom color spray paint can 20 being operated by user 22 using his finger 24. A wall surface 26 receives the sprayed paint 28.

Figure 2:
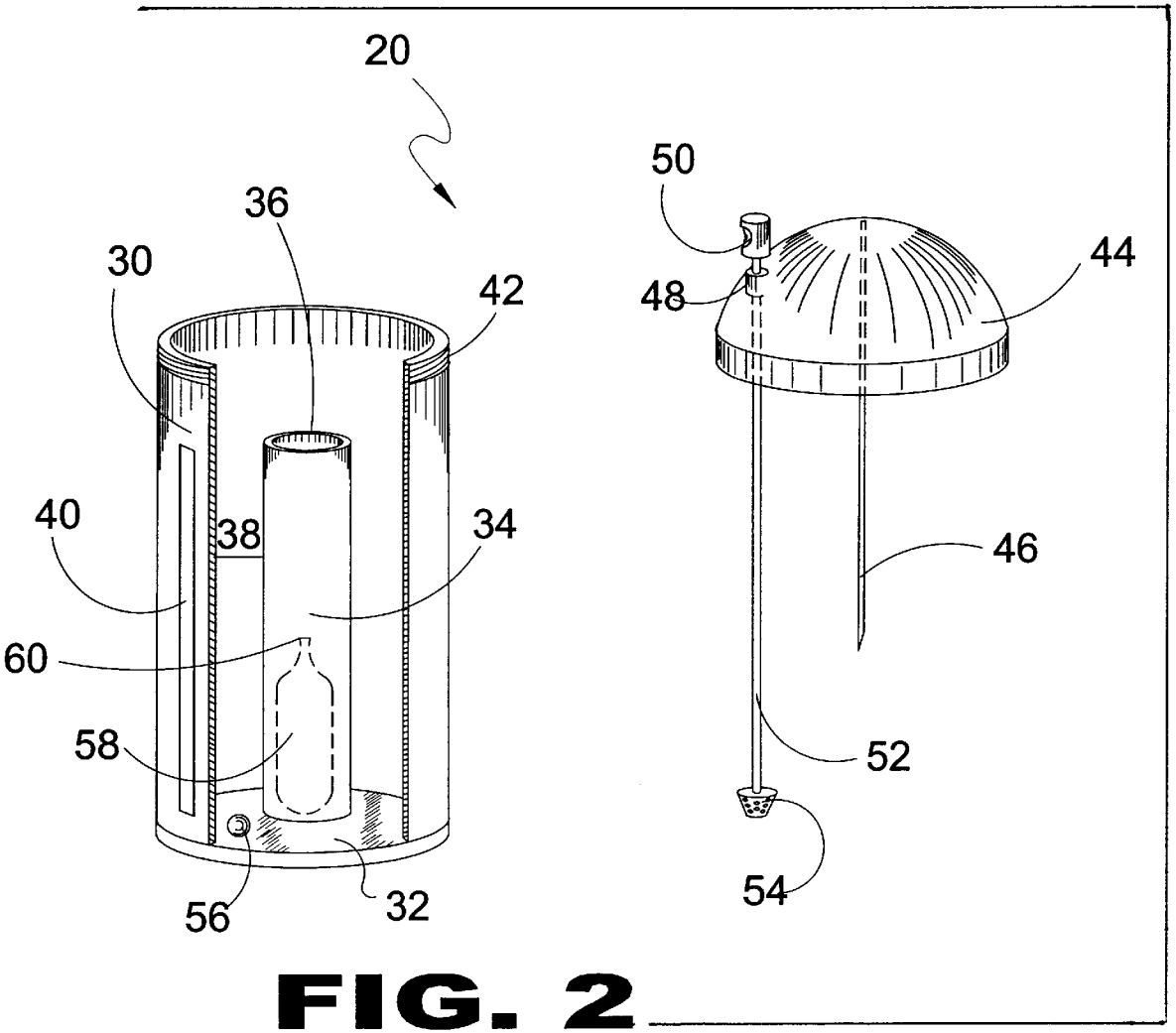
Figure 3:
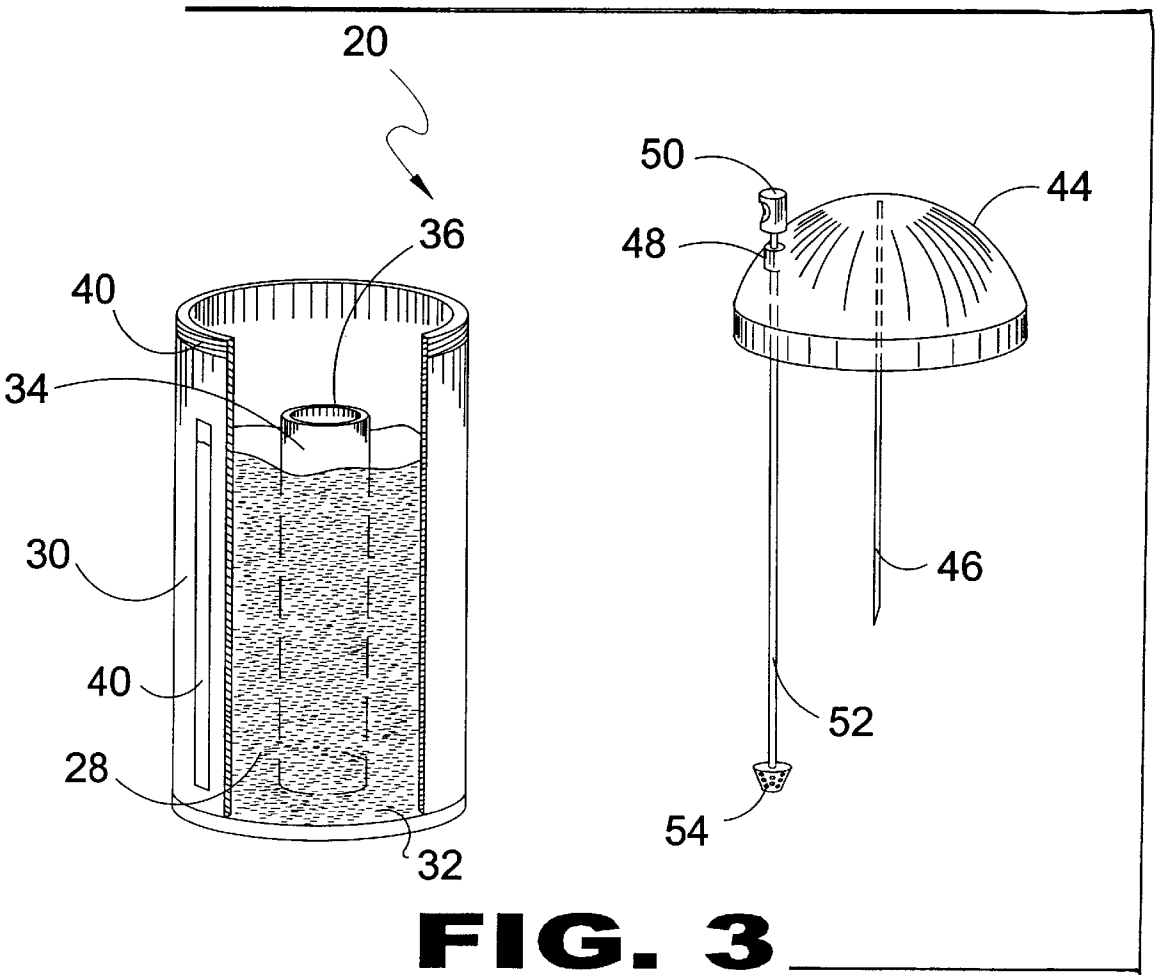

FIG. 2 depicts the custom color spray paint can 20 in its open state. A cylindrical container 30 has a bottom 32 and a centrally positioned guide tube 34. The guide tube 34 has an upwardly disposed opening 36. An annulus 38 is formed between the guide tube 34 and the container 30. Paint 28 is stored in the annulus 38, as shown in FIG. 3. The paint level can be viewed through a sight glass 40 positioned vertically on the container 30.

The container 30 has threads 42 for threaded coupling with a dome cap 44. Extending downwardly from the apex of the dome cap 44 is a puncturing pin 46. Other embodiments provide sealing materials and sealing devices such as conventional rubber O-rings, seals, and the like.

Figure 7:
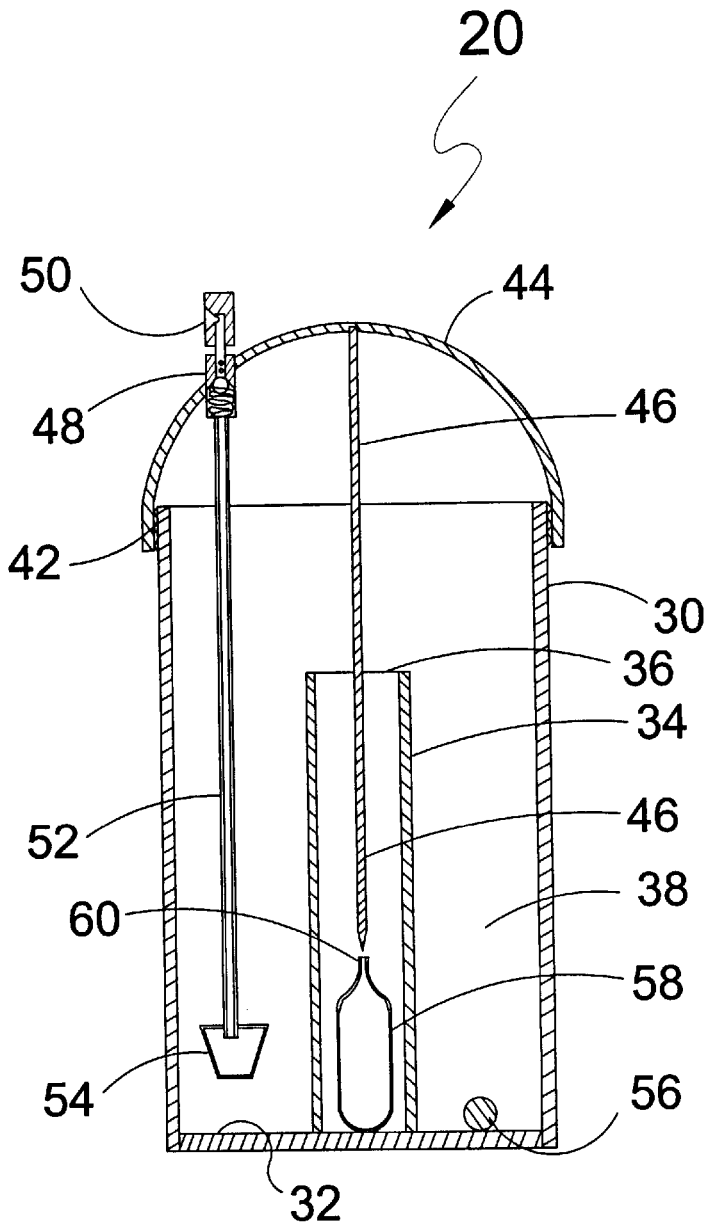
Figure 8:
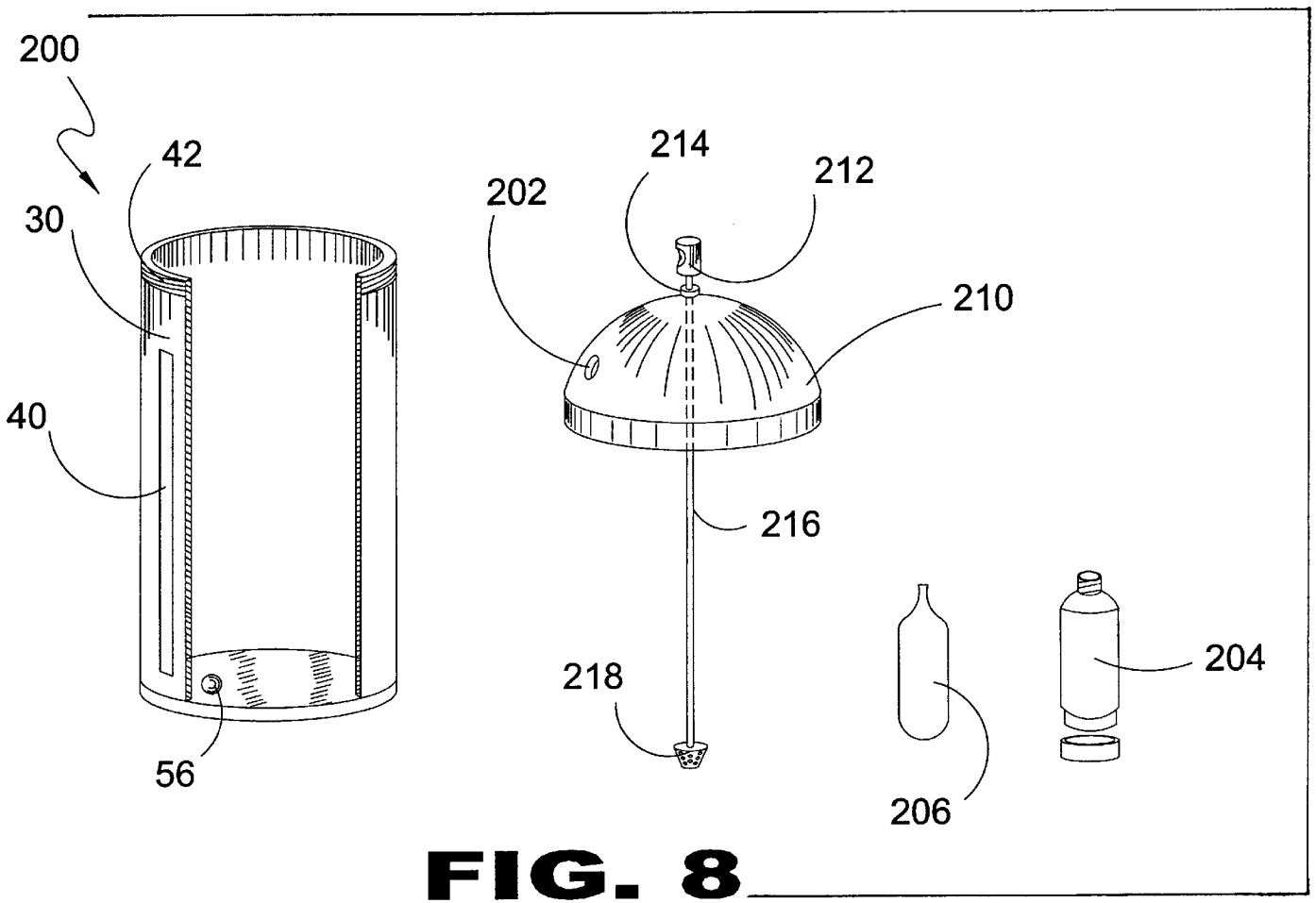
Figure 9:
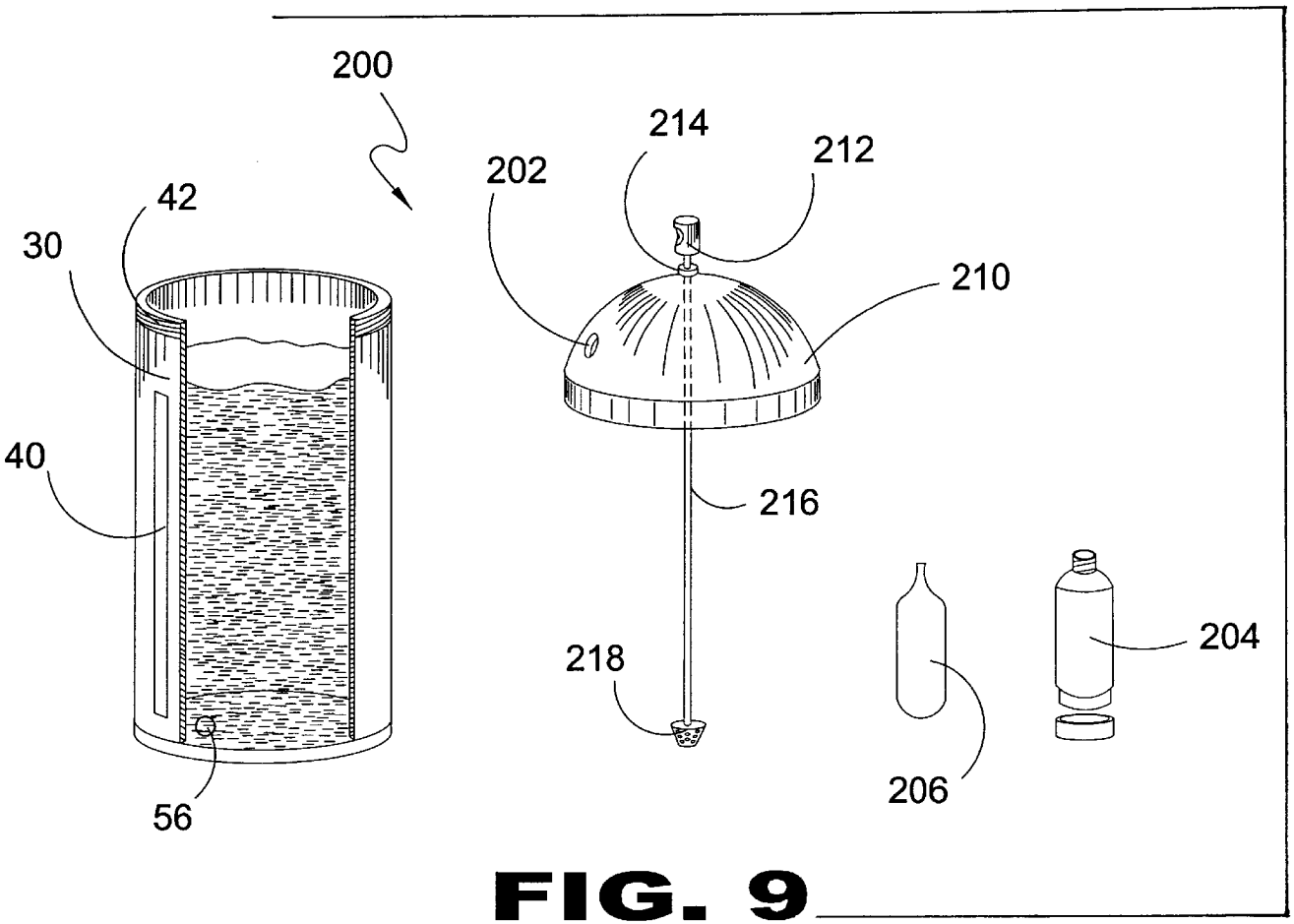
FIG. 9 is a view showing the components of the alternate embodiment with the addition of paint or other fluid wherein the top is ready for attachment to the container housing.
Figure 10:
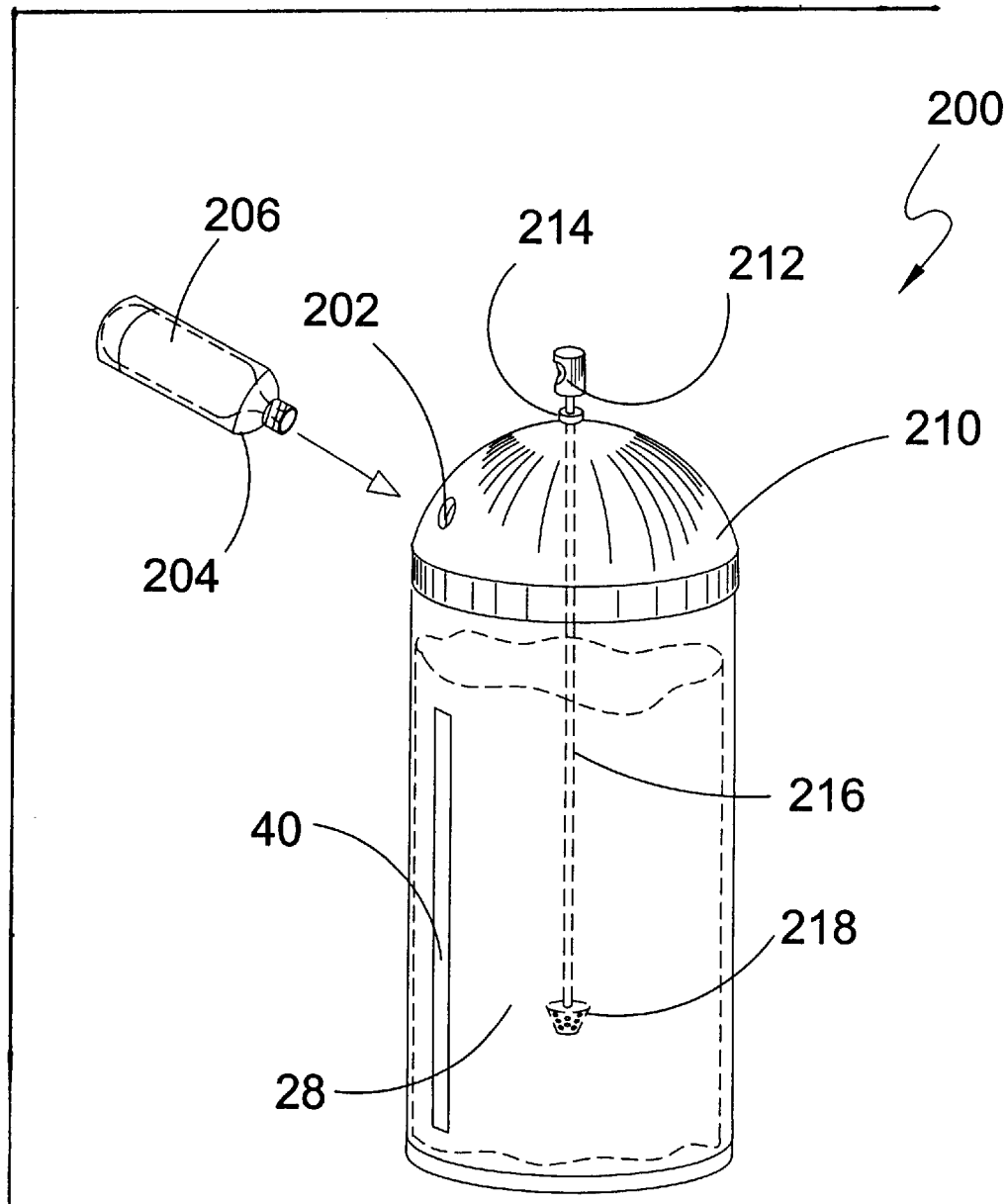
FIG. 10 is an illustration showing that once the paint or fluid has been added to the container, the domed top is secured ensuring an effective seal. The cartridge carrier is then mated with the charging port for compressed gas transfer and container pressurization.
Figure 11:
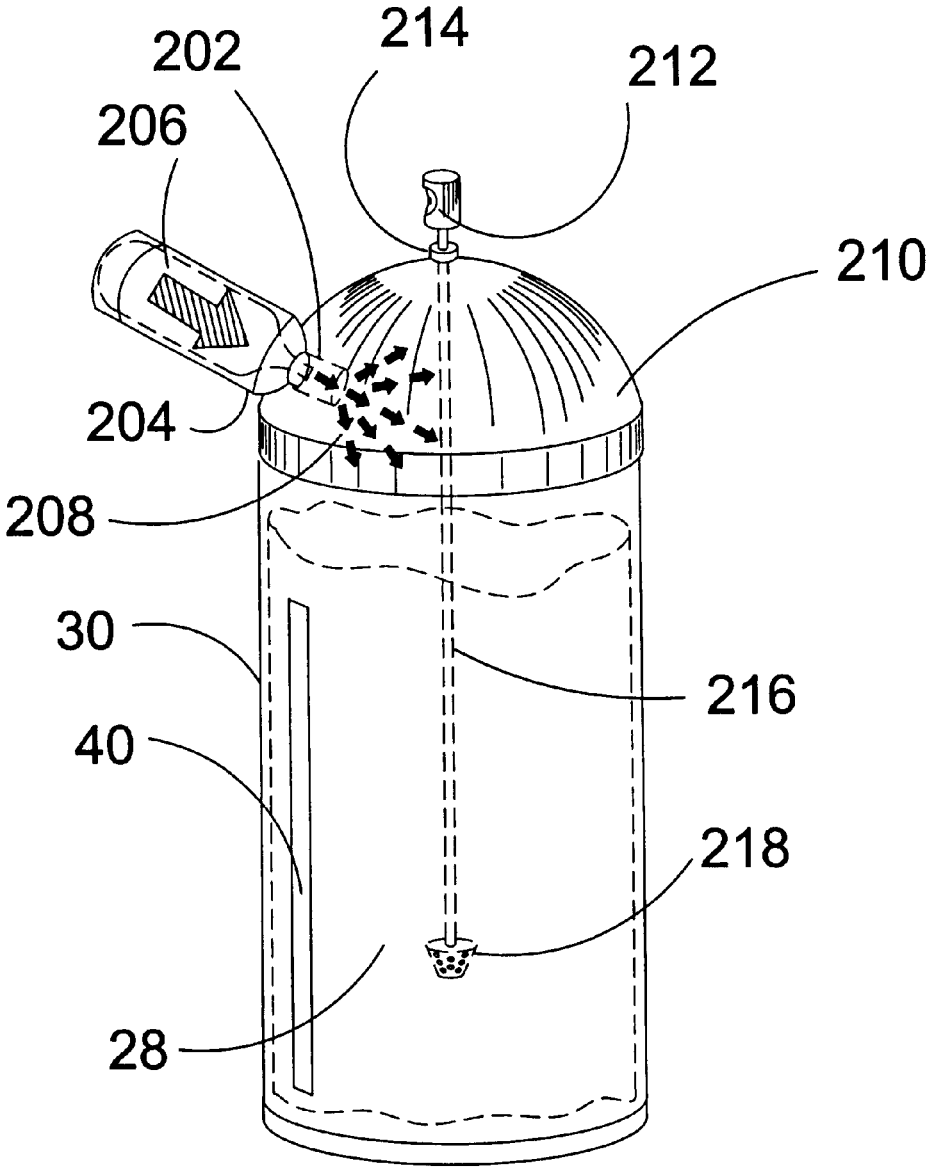
FIG. 11 is a view where the carrier is threaded into the charging port and the gas cartridge is compromised, thus flowing the gas into the container. The internal pressure of the container due to the addition of compressed gas is maintained by the one-way valves located in the spray nozzle assembly and the inlet member in addition to the sealed cap structure and the container.
Figure 12:
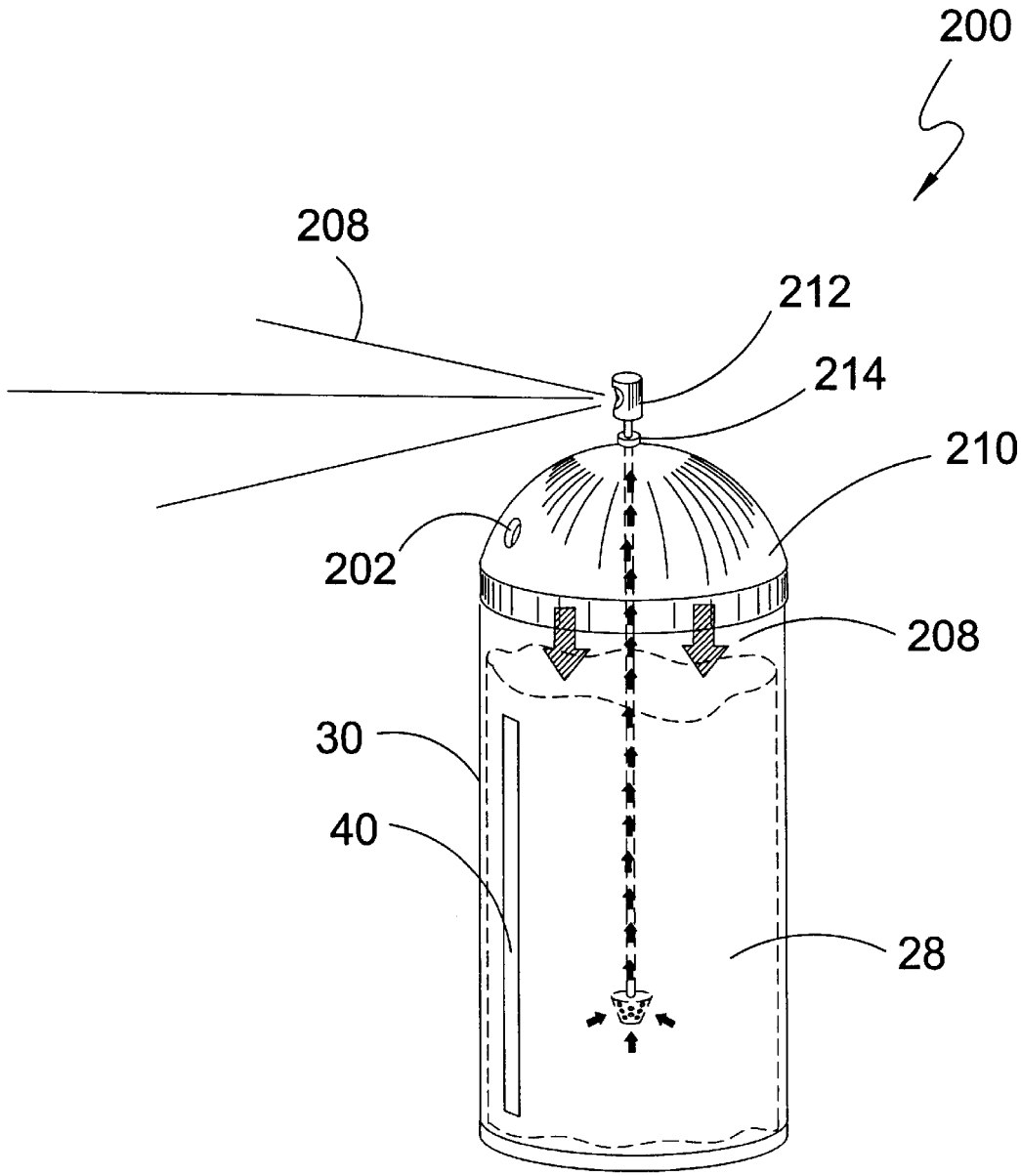
FIG. 12 is a view where the container has been charged with compressed gas, and the paint or other fluid is discharged via the spray nozzle.

As shown in FIG. 7, a conventional spring and ball valve 48 is sealably positioned on the dome cap 44 and is in fluid communication, and is manipulated by, a nozzle 50 positioned for depression by the user's finger 24. A conduit 52 extends from the valve 48 and terminates proximate the container bottom 32. A filter 54 is positioned on the conduit 52 to restrain solid particles in the paint 28 from entering the conduit 52. A steel ball 56 is placed in the container 30 for agitating the paint 28 during motion of the container 30.

Figure 4:
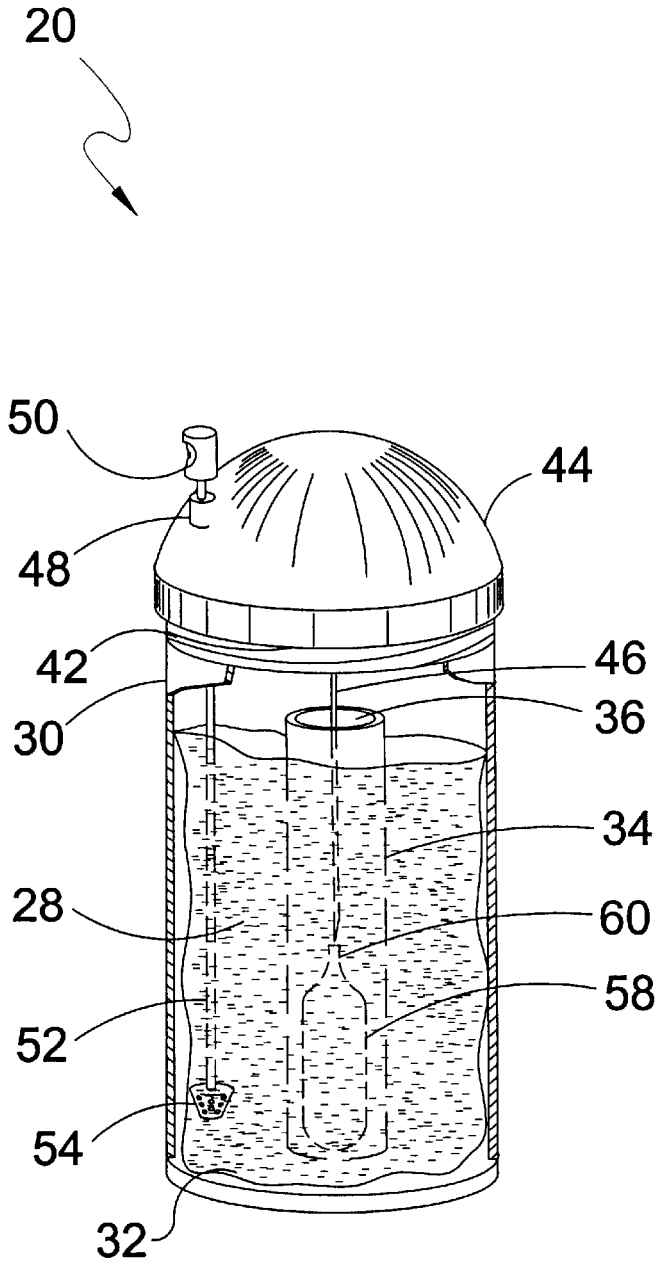

Positioned within the guide tube 34 is a gas cartridge 58 containing pressured gas. Usable gases include methane, or other gas propellants typically chosen for conventional paint spray cans. The cartridge 58 has a puncturable discharge outlet 60 that is aligned with the pin 46. As shown in FIG. 4, the puncture pin 46 is positioned to enter the discharge outlet 58 as the dome cap 44 is threaded onto the container threads 42. Other puncturing means are provided, including a cartridge positioned higher within the container 30, both with and without a guide tube 34.

Figure 5:
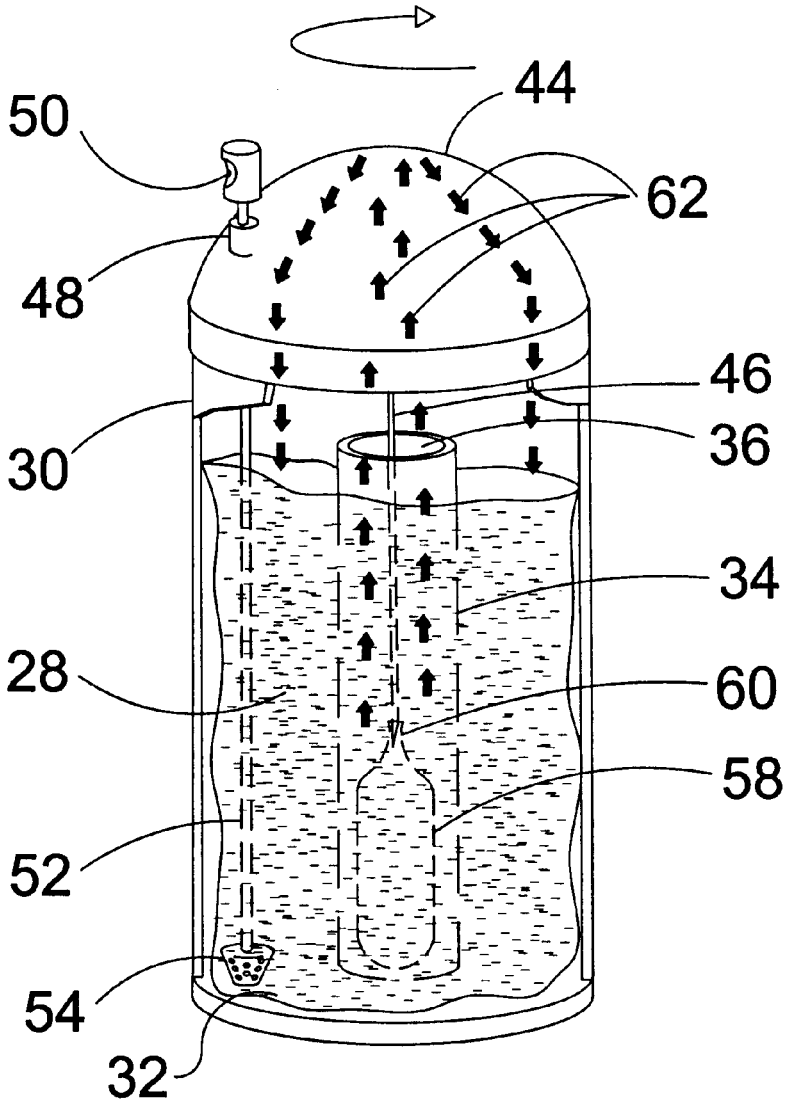

FIG. 5 indicates the path of the released gas 62 as it exits the discharge outlet 58 when the pin 46 has punctured the cartridge 58. The gas 62 is held within the guide tube 34 until the gas 62 passes through the guide tube opening 36 and enters the enclosure formed by the container 30 and the attached dome cap 44. As the container 30 interior is pressurized, the gas 62 attempts to displace the paint 28 in a downward direction in the annulus 38. An equilibrium state exists until the user 22 depresses the nozzle 50 and opens the release valve 48. When the valve 48 is open the paint 28 is free to enter the conduit 52 and travel through the valve 48 and through the nozzle 50.

The nozzle 50 and valve 48 are of the type typically used in conventional spray paint cans. In other embodiments, other nozzles, including adjustable nozzles, other valves, including handle and knob-operated valves, nozzle extensions and hoses are used as means for applying the paint to the wall surface 26 by regulating and directing the amount and discharge pattern of the paint 28.

The removable and reattachable dome cap 44 optimizes and improves the utility beyond that of conventional spray paint cans. As shown in FIG. 1, several of the custom color spray paint cans 20 can be used and reused for continuous replacement and/or mixture of paint 28, the open container 30 allowing exact color customization by providing easy mixing access and clear visual observation of the paint 28 in the annulus 38 as color mixing proceeds. The sight glass 40 improves the ability of the user 22 to accurately assess the remaining amount of paint 28, and to know the custom color then present in the container 30.

For example, the user 22 opens an un-pressured custom color spray paint can 20 by unscrewing the dome cap 44. One or more paint colors are placed in the annulus 38 until the user 22 observes that the custom color that he or she desired has been obtained. A fresh cartridge 58 is placed in the guide tube 34 if needed with the puncturable discharge outlet 60 facing up. The user 22 then begins to screw the dome cap 44 onto the container 30, and as the dome cap 44 nears its final position the puncture pin 46 pierces the gas cartridge 58 at the discharge outlet 60. The cartridge gas 62 is released only after the dome cap 44 has adequately sealed the container 30.

The release of the gas 62 pressurizes the container 30 and the paint 28 is disposed to exit the container 30. The user 22 approaches the wall surface 26 or other surface to be painted, with the custom color spray paint can 20 in hand. Upon directing the nozzle 50 toward the wall surface 26, the user's finger 24 depresses the nozzle 50 and the release valve 48 is opened. The internal gas 62 pressure causes the paint 28 to be displaced through the filter 54 where any solid particles in the paint 28 are prevented from entering the conduit 52. The filtered paint 28 enters the conduit 52 and passes through the valve 48 then the nozzle 50, the nozzle 50 directing the paint 28 to the wall surface 26.

Figure 6:
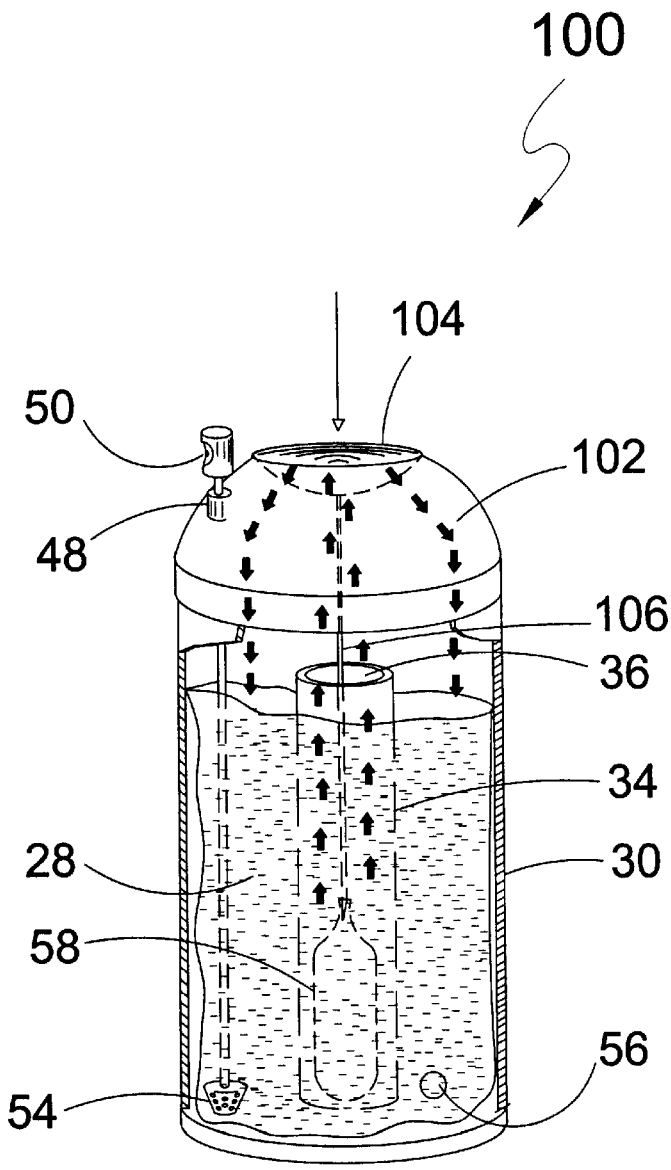

In another embodiment 100 a modified dome cap 102 has a deformable apex 104 to which a shorter puncturing pin 106 is attached, as shown in FIG. 6. The shorter pin 106 does not puncture the gas cartridge 58 as the dome cap 102 is completely screwed onto the container 30. However, when the deformable apex 104 is pushed downward, the pin 106 accomplishes the puncturing function, and the gas 62 is released as in the above-described embodiment 20. Embodiments include both elastically deformable and permanently deformable dome cap apexes 104, including those made from various metals and plastics.

In another embodiment 200 an inlet member 202 is provided for mating with a gas cartridge carrier 204, as shown in FIGS. 8–12. Within the carrier 204 is a gas cartridge 206 that releases gas 208 as the carrier 204 is mated to the inlet member 202. In this embodiment 200 the carrier is threaded into the inlet member 202, although other means for mating the carrier 204 to the inlet member 202 are provided in other embodiments. The inlet member 202 is positioned on a modified dome cap 210 that screws onto the container 30, providing the same functionality as the above embodiments 20,100. No puncture pin or guide tube is involved in this embodiment 200. The nozzle 212, valve 214, conduit 216 and filter 218 are relocated to the center of the dome cap 210.

With respect to the above description then, it is to be realized that the optimum material and dimensional relationships for the parts of the custom color spray paint can 20, will include variations in size, materials, shape, and form, which will occur to those skilled in the art upon review of the present disclosure. In various embodiments, the materials for the container 30, dome cap 44,102,210, puncture pin 46,106, nozzle 50,212, valve 48,214, conduit 52,216, and the ball 56, are various metals and plastics. Embodiments include various plastics for the filter 54,218. All embodiments of the present invention can be used, with little or no adaptation, for fluids other than paints, including various chemical mixtures, and the like. All equivalent relationships to those illustrated in the drawings and described in the specification are intended to be encompassed by the present invention.

What is claimed as new and desired to be protected by Letters Patent is set forth in the appended claims:

1. A paint dispenser, comprising:

a paint container for holding paint, the paint container having a removable and reattachable lid;

a pressurized gas container having a puncturable discharge outlet, the gas container containing a pressurized gas, the gas container being positioned within the paint container;

a puncturing member extending from the lid, the puncturing member being positioned with respect to the gas container discharge outlet such that attachment of the lid to the paint container causes the puncturing member to puncture the gas container discharge outlet, the punctured discharge outlet releasing the pressurized gas into the paint container, the released pressurized gas causing the paint container to become pressurized; and a paint application member having a release valve, the manipulation of the release valve allowing paint to be displaced from the paint container under pressure.

2. The paint dispenser of claim 1, wherein a hollow member is positioned within the paint container and about the gas container, forming an annulus between the hollow member and the gas container such that the paint in the paint container is segregable in the annulus, and further such that gas discharged from the gas container discharge outlet is routed by the hollow member to the annulus above the paint.

3. The paint dispenser of claim 1, wherein the dispenser further comprises an elongated transparent member, the paint container being adapted to position the transparent member on the paint container such that at least part of the interior of the paint container is visible from outside the paint container.

4. The paint dispenser of claim 1, wherein the dispenser further comprises a paint agitator member, the agitator member being unrestrained such that motion of the paint container causes the agitator member to move within the paint.

5. The paint dispenser of claim 1, wherein the paint application member is positioned on the paint container below the lid.

6. The paint dispenser of claim 1, wherein the paint application member is positioned on the lid, and further wherein the paint container has a bottom and the dispenser further comprises an elongated conduit having a first end in fluid communication with the paint application member and a second end positioned proximate the paint container bottom such that paint is drawn through the conduit from the bottom of the container.

7. The paint dispenser of claim 6, wherein the elongated conduit second end has a filter for filtering solid particles in the paint as the paint enters the elongated conduit.

8. The paint dispenser of claim 1, wherein the paint application member has a finger-operable nozzle, such that depression of the nozzle opens the release valve causing paint to be released for directed application through the nozzle.

9. The paint dispenser of claim 8, wherein the nozzle is adjustable for regulating the amount and pattern of paint discharge.

10. A paint dispenser, comprising:

a paint container for holding paint, the paint container having a removable and reattachable lid;

a pressurized gas container having a puncturable discharge outlet, the gas container containing a pressurized gas, the gas container being positioned within the paint container;

means for puncturing the discharge outlet, the punctured discharge outlet releasing the pressurized gas into the paint container, the released pressurized gas causing the paint container to become pressurized;

means for selectively releasing paint from the gas container under pressure and directing the released paint; and the dispenser further comprises means for segregating the paint from the gas container discharge outlet such that the released gas is released above the paint in the paint container.

11. The paint dispenser of claim 10, wherein the dispenser flirter comprises means for visually determining the level of paint in the gas container.

12. The paint dispenser of claim 10, wherein the dispenser further comprises means for agitating the paint in response to motion of the paint container.

13. The paint dispenser of claim 10, wherein the means for selectively releasing paint from the gas container is positioned on the lid, and flier wherein the paint container has a bottom and the dispenser further comprises an elongated conduit having a first end in fluid communication with the means for selectively releasing paint from the gas container, and a second end positioned proximate the paint container bottom such that paint is drawn through the conduit from the bottom of the container.

14. The paint dispenser of claim 13, wherein the elongated conduit second end has means for filtering solid particles in the paint as the paint enters the elongated conduit.

15. A paint dispenser, comprising:

a paint container for holding paint, the paint container having a removable, reattachable, and deformable lid;

a pressurized gas container having a puncturable discharge outlet, the gas container containing a pressurized gas, the gas container being positioned within the paint container;

a puncturing member extending from the lid, the puncturing member being positioned with respect to the gas container discharge outlet such that deformation of the attached lid causes the puncturing member to puncture the gas container discharge outlet, the punctured discharge outlet releasing the pressurized gas into the paint container, the released pressurized gas causing the paint container to become pressurized; and a paint application member having a release valve, the manipulation of the release valve allowing paint to be displaced from the paint container under pressure.

16. The paint dispenser of claim 15, wherein a hollow member is positioned within the paint container and about the gas container, forming an annulus between the hollow member and the gas container such that the paint in the paint container is segregable in the annulus, and further such that gas discharged from the gas container discharge outlet is routed by the hollow member to the annulus above the paint.

17. The paint dispenser of claim 15, wherein the dispenser further comprises an elongated transparent member, the paint container being adapted to position the transparent member on the paint container such that at least part of the interior of the paint container is visible from outside the paint container.

18. The paint dispenser of claim 15, wherein the dispenser her comprises a paint agitator member, the agitator member being unrestrained such that motion of the paint container causes the agitator member to move within the paint.

19. The paint dispenser of claim 15, wherein the paint application member is positioned on the paint container below the lid.

20. The paint dispenser of claim 15, wherein the paint application member is positioned on the lid, and fisher wherein the paint container has a bottom and the dispenser further comprises an elongated conduit having a first end in fluid communication with the paint application member and a second end positioned proximate the paint container bottom such that paint is drawn through the conduit from the bottom of the container.

21. The paint dispenser of claim 20, wherein the elongated conduit second end has a filter for filtering solid particles in the paint as the paint enters the elongated conduit.

22. The paint dispenser of claim 15, wherein the paint application member has a finger-operable nozzle, such that depression of the nozzle opens the release valve causing paint to be released for directed application through the nozzle.

23. The paint dispenser of claim 22, wherein the nozzle is adjustable for regulating the amount and pattern of paint discharge.

24. The paint dispenser of claim 15, wherein the lid deformation is elastic.

25. The paint dispenser of claim 15, wherein the lid deformation is permanent.

26. A paint dispenser, comprising:

a paint container for holding paint, the paint container having a bottom and a removable and reattachable lid;

a pressurized gas container having a puncturable discharge outlet, the gas container containing a pressurized gas, the gas container being positioned within the paint container, a puncturing member extending from the lid, the puncturing member being positioned with respect to the gas container discharge outlet such that attachment of the lid to the paint container causes the puncturing member to puncture the gas container discharge outlet, the punctured discharge outlet releasing the pressurized gas into the paint container, the released pressurized gas causing the paint container to become pressurized;

an elongated transparent -member, the paint container being adapted to position the transparent member on the paint container such that at least part of the interior of the paint container is visible from outside the paint container;

a hollow member positioned within the paint container and about the gas container, forming an annulus between the hollow member and the gas container such that the paint in the paint container is segregable in the annulus, and further such that gas discharged from the gas container discharge outlet is routed by the hollow member to the annulus above the paint;

a paint agitator member, the agitator,member being unrestrained such that motion of the paint container causes the agitator member to move within the paint;

a paint application member having a release valve, the manipulation of the release valve allowing paint to be displaced from the paint container under pressure the paint application member being positioned on the lid h ee pant application member having a finger-operable nozzle, such that depression of the nozzle opens the release valve causing paint to be released through the nozzle, the nozzle being adjustable for regulating the amount and pattern of paint discharge; and an elongated conduit having a first end in fluid communication with the paint application member and a second end positioned proximate the paint container bottom such that paint is drawn through the conduit from the bottom of the container, the elongated conduit second end having a filter for filtering solid particles in the paint.

27. The paint dispenser of the claim 26, further comprising a seal member positioned between the dome cap and the container.

* * * * *